US008188000B2

(12) United States Patent
Koide et al.

(10) Patent No.: US 8,188,000 B2
(45) **Date of Patent: *May 29, 2012**

(54) HEAT-SENSITIVE TRANSFER IMAGE-RECEIVING SHEET AND METHOD OF PRODUCING THE SAME

(75) Inventors: Tomoyuki Koide, Tokyo (JP); Kazuaki Oguma, Minami-ashigara (JP); Yasufumi Nakai, Tokyo (JP); Shinichiro Morimoto, Kanagawa (JP); Shigeru Shibayama, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 856 days.

This patent is subject to a terminal disclaimer.

(21) Appl. No.: 12/200,678

(22) Filed: Aug. 28, 2008

(65) Prior Publication Data

US 2009/0061124 A1 Mar. 5, 2009

(30) Foreign Application Priority Data

Aug. 29, 2007 (JP) ..... 2007-223194

(51) Int. Cl.
*B41M 5/035* (2006.01)
*B41M 5/50* (2006.01)

(52) U.S. Cl. ..... 503/227

(58) Field of Classification Search ..... None
See application file for complete search history.

(56) References Cited

U.S. PATENT DOCUMENTS

| | | | | |
|---|---|---|---|---|
| 4,778,782 | A | 10/1988 | Ito et al. | |
| 7,381,685 | B2 * | 6/2008 | Oguma et al. | 503/227 |
| 7,485,402 | B2 * | 2/2009 | Arai et al. | 430/201 |
| 7,786,039 | B2 * | 8/2010 | Koide et al. | 503/227 |
| 7,790,346 | B2 * | 9/2010 | Irita | 430/200 |
| 7,799,736 | B2 * | 9/2010 | Irita et al. | 503/227 |
| 7,816,064 | B2 * | 10/2010 | Oguma et al. | 430/201 |
| 7,858,557 | B2 * | 12/2010 | Takehara | 503/227 |
| 7,867,945 | B2 * | 1/2011 | Takehara | 503/227 |
| 7,897,542 | B2 * | 3/2011 | Oguma et al. | 503/227 |
| 2007/0148378 | A1 | 6/2007 | Koide et al. | |

FOREIGN PATENT DOCUMENTS

| | | | |
|---|---|---|---|
| EP | 0234563 | A2 | 9/1987 |
| EP | 0537485 | A1 | 4/1993 |
| JP | 64-47586 | A | 2/1989 |
| JP | 5-229265 | A | 9/1993 |
| JP | 05-229265 | A | 9/1993 |
| JP | 05-301476 | A | 11/1993 |
| JP | 9-202507 | A | 8/1997 |
| JP | 2000-238440 | * | 9/2000 |
| JP | 2002-211142 | A | 7/2002 |
| JP | 2004-009572 | * | 1/2004 |
| JP | 2005-335115 | A | 12/2005 |
| JP | 2007-160885 | A | 6/2007 |

OTHER PUBLICATIONS

Japanese Office Action issued Sep. 13, 2011 for counterpart Japanese Application No. 2007-223194.

* cited by examiner

*Primary Examiner* — Bruce H Hess
(74) *Attorney, Agent, or Firm* — Sughrue Mion, PLLC

(57) ABSTRACT

A heat-sensitive transfer image-receiving sheet having a support and, on each of both sides of the support, at least one receptor layer containing at least one kind of latex polymer; a heat-sensitive transfer image-receiving sheet containing a support and, on each of both sides of the support, are formed at least one interlayer, at least one heat insulation layer containing at least one kind of hollow polymer, and at least one receptor layer in this order from the support; and a method of producing a heat-sensitive transfer image-receiving sheet comprising a support and, on each of both sides of the support, at least one receptor layer containing at least one kind of latex polymer, which method including forming the receptor layer by applying a receptor layer-coating liquid which has a solid content in the range of from 5% by mass to 50% by mass, per one coating operation.

15 Claims, No Drawings

HEAT-SENSITIVE TRANSFER IMAGE-RECEIVING SHEET AND METHOD OF PRODUCING THE SAME

FIELD OF THE INVENTION

The present invention relates to a heat-sensitive transfer image-receiving sheet and a method of producing the same. Especially, the present invention provides a heat-sensitive transfer image-receiving sheet that is able to form a high quality image on both sides of a support, and moreover that is suitable for production thereof. Further, the present invention provides a method of producing the same.

BACKGROUND OF THE INVENTION

Various heat transfer recording methods have been known so far. Among these methods, dye diffusion transfer recording systems attract attention as a process that can produce a color hard copy having an image quality closest to that of silver halide photography. Moreover, this system has advantages over silver halide photography: it is a dry system, it enables direct visualization from digital data, it makes reproduction simple, and the like.

In the dye diffusion transfer recording systems, a dye-containing heat-sensitive transfer sheet (hereinafter also simply referred to as "an ink sheet") and a heat-sensitive transfer image-receiving sheet (hereinafter also simply referred to as "an image-receiving sheet") are superposed, and the ink sheet is heated using a thermal head with which heat generation can be controlled by electric signals. Thereby a colorant (hereinafter also referred to as "a dye") in the ink sheet is transferred to the image-receiving sheet to record image information. More specifically, a transferred color image with a continuous change in color shading can be obtained by recording three colors including cyan, magenta and yellow, or four colors including black in addition to the three colors in the manner of one over another.

Owing to a recent progress of computerized digital image processing technique, a quality of the recorded image is improving and a market of the dye diffusion transfer recording system is growing. In accordance with the growth of market, a demand for both speed-up of the print system and high density imaging is increasing.

Moreover, the need of a double-side print with a photographic quality is increasing from a demand for making of photo-books.

Heat-sensitive transfer image-receiving sheets for a double-side print have been proposed from the past (see U.S. Pat. No. 4,778,782, JP-A-64-47586 ("JP-A" means unexamined published Japanese patent application), JP-A-5-229265, JP-A-9-202057 and JP-A-2002-211142). However, these image-receiving sheets had problems such that image quality of one side is not satisfactory for photographic-image reproduction, and that these sheets are difficult in handling because if these sheets after being formed with a receptor layer are stored in a state wherein the front side of a sheet is in contact with the back side of another sheet, they would be adhered to each other. For example, in U.S. Pat. No. 4,778,782, JP-A-64-47586 and JP-A-5-229265, it has been suggested forming a sublimation type receptor layer on both sides. However, image qualities did not satisfy the demand. Further, there were problems in production. On the other hand, in JP-A-9-202057 and JP-A-2002-211142, it has been suggested sheets both sides of which can be printed. However, image qualities did not satisfy the demand for photographic image reproduction.

SUMMARY OF THE INVENTION

The present invention resides in a heat-sensitive transfer image-receiving sheet having a support and, on each of both sides of the support, at least one receptor layer containing at least one kind of latex polymer.

Further, the present invention resides in a heat-sensitive transfer image-receiving sheet having a support and, on each of both sides of the support, at least one interlayer, at least one heat insulation layer containing at least one kind of hollow polymer, and at least one receptor layer in this order from the support.

Furthermore, the present invention resides in a method of producing a heat-sensitive transfer image-receiving sheet having a support and, on each of both sides of the support, at least one receptor layer containing at least one kind of latex polymer, which method comprising forming the receptor layer by applying a receptor layer coating liquid which has a solid content in the range of from 5% by mass to 50% by mass, per one coating operation.

Other and further features and advantages of the invention will appear more fully from the following description.

DETAILED DESCRIPTION OF THE INVENTION

The present invention provides the following means:

(1) A heat-sensitive transfer image-receiving sheet having a support and, on each of both sides of the support, at least one receptor layer containing at least one kind of latex polymer.

(2) The heat-sensitive transfer image-receiving sheet as described in the above item (1), wherein a thickness of at least one of the receptor layers is in the range of from 0.1 μm to 30 μm.

(3) The heat-sensitive transfer image-receiving sheet as described in the above item (1) or (2), wherein the latex polymer in at least one of the receptor layers is one or at least two kinds of latex polymer selected from vinyl chloride/acrylic compound latex copolymer, vinyl chloride/vinyl acetate latex copolymer, and vinyl chloride/vinyl acetate/acrylic compound latex copolymer.

(4) The heat-sensitive transfer image-receiving sheet as described in any one of the above items (1) to (3), wherein a coating liquid for the receptor layer to be applied per one coating operation has a solid content in the range of from 5% by mass to 50% by mass.

(5) The heat-sensitive transfer image-receiving sheet as described in any one of the above items (1) to (4), wherein a coating liquid for at least one of the receptor layers has a viscosity in the range of from 3 mPa·s to 300 mPa·s.

(6) The heat-sensitive transfer image-receiving sheet as described in any one of the above items (1) to (5), wherein a coating amount of a coating liquid for the receptor layer to be applied per one coating operation is in the range of from 3 $ml/m^2$ to 300 $ml/m^2$.

(7) The heat-sensitive transfer image-receiving sheet as described in any one of the above items (1) to (6), wherein the receptor layer with the lapse of time that is within 5 seconds directly after coating is kept for 3 seconds or more at a constant dry-bulb temperature of less than 25° C.

(8) The heat-sensitive transfer image-receiving sheet as described in any one of the above items (1) to (7), wherein the receptor layer with the lapse of time that is after 5 seconds but within 60 seconds directly after coating is kept for 3 seconds or more at a constant dry-bulb temperature of less than 80° C.

(9) A heat-sensitive transfer image-receiving sheet having a support and, on each of both sides of the support, at least one interlayer, at least one heat insulation layer containing at least one kind of hollow polymer, and at least one receptor layer in this order from the support.

(10) The heat-sensitive transfer image-receiving sheet as described in the above item (9), wherein at least one of the receptor layers contains at least one kind of latex polymer.

(11) The heat-sensitive transfer image-receiving sheet as described in the above item (10), wherein the latex polymer is one or at least two kinds of latex polymer selected from vinyl chloride/acrylic compound latex copolymer, vinyl chloride/vinyl acetate latex copolymer, and vinyl chloride/vinyl acetate/acrylic compound latex copolymer.

(12) The heat-sensitive transfer image-receiving sheet as described in any one of the above items (9) to (11), wherein the interlayer is free of gelatin.

(13) A method of producing a heat-sensitive transfer image-receiving sheet having a support and, on each of both sides of the support, at least one receptor layer containing at least one kind of latex polymer, which method comprising forming the receptor layer by applying a receptor-layer coating-liquid which has a solid content in the range of from 5% by mass to 50% by mass, per one coating operation.

(14) The method of producing a heat-sensitive transfer image-receiving sheet as described in the above item (13), wherein a viscosity of the receptor layer-coating liquid is in the range of from 3 mPa·s to 300 mPa·s.

(15) The method of producing a heat-sensitive transfer image-receiving sheet as described in the above item (13) or (14), wherein a coating amount of the receptor layer-coating liquid coated per one coating operation is in the range of from 3 $ml/m^2$ to 300 $ml/m^2$.

(16) The method of producing a heat-sensitive transfer image-receiving sheet as described in any one of the above items (13) to (15), wherein the receptor layer with the lapse of time that is within 5 seconds directly after coating is kept for 3 seconds or more at a constant dry-bulb temperature of less than 25° C.

(17) The method of producing a heat-sensitive transfer image-receiving sheet as described in any one of the above items (13) to (16), wherein the receptor layer with the lapse of time that is after 5 seconds but within 60 seconds directly after coating is kept for 3 seconds or more at a constant dry-bulb temperature of less than 80° C.

The present invention is explained in detail below.

The heat-sensitive transfer image-receiving sheet of the invention (hereinafter also referred to as "the image-receiving sheet of the present invention") has at least one receptor layer (dye receptive layer) on each of both sides of the support.

In the first embodiment of the invention, the receptor layer contains at least one kind of latex polymer. In the second embodiment of the invention, on each of both sides of the support, there are an interlayer and a heat insulation layer (porous layer) containing at least one hollow polymer particles disposed in this order from the support and between the receptor layer and the support.

The interlayer in the second embodiment may be any interlayer having any one of various functions such as white background adjustment, antistatic, adhesion and leveling. It is also preferred that the first embodiment has such a functional interlayer. It is also preferred that the receptor layer of the first embodiment is applied to that of the second embodiment. Further, it is also preferred in the first embodiment that the foregoing interlayer and heat insulation layer are disposed between the receptor layer and the support in this order from the support. It is also preferred that the heat insulation layer of the second embodiment is applied to that of the first embodiment.

Further, it is preferred that the details described below are applied to each of both sides of the support.

In each of the embodiments (hereinafter referred to as "the present invention"), a release layer may be formed at the outermost layer of the side on which the heat-sensitive transfer sheet is superposed. The formation of the release layer is preferred.

At least one of these layers is preferably formed by applying a water-based coating liquid. Each of these layers is applied using a common method, such as a roll coating, a bar coating, a gravure coating, a gravure reverse coating, a die coating, a slide coating and a curtain coating. Each of the receptor layer, the heat insulation layer and the interlayer may be individually coated. Alternatively, a combination of any of these layers may be applied by simultaneous multilayer coating. It is especially preferred that mutually adjacent layers are applied by simultaneous multilayer coating.

Each of layers is explained below.

Receptor Layer

The heat-sensitive transfer image-receiving sheet of the present invention contains at least a thermoplastic polymer capable of receiving a dye. Examples of preferable receptive polymers include vinyl-based resins such as polyvinyl acetate, ethylene vinyl acetate copolymer, vinyl chloride vinyl acetate copolymer, vinyl chloride acrylate copolymer, vinyl chloride methacrylate copolymer, polyacrylate, polystyrene, and acrylic polystyrene; acetal-based resins such as polyvinyl formal, polyvinyl butyral, and polyvinyl acetal; polyester-based resins such as polyethyleneterephthalate, polybutyleneterephthalate, and polycaprolactone; polycarbonate-based resins; polyurethane-series resins; cellulose-based resins; polyolefin-based resins such as polypropylene; polyamide-based resins; and amino-based resins such as urea resins, melamine resins and benzoguanamine resins. These resins may be used optionally blending with each other in the range of compatibility.

It is further preferable, among these polymers, to use a polycarbonate, a polyester, a polyurethane, a polyvinyl chloride or a copolymer of vinyl chloride, a styrene-acrylonitrile copolymer, a polycaprolactone or a mixture of two or more of these. It is particularly preferable to use a polyester, a polyvinyl chloride or a copolymer of vinyl chloride or a mixture of two or more of these.

The above-exemplified polymers may be dissolved in a proper organic solvent such as methylethyl ketone, ethyl acetate, benzene, toluene, and xylene so that they can be coated on a support. Alternatively, they may be added to a water-based coating liquid as latex polymer so that they can be coated on a support.

Further, the receptor layer may contain ultraviolet absorbents, releasing agents, sliding agents, antioxidants, antiseptics, and surfactants.

In the first embodiment of the invention (a preferable embodiment of the second embodiment), at least one polymer is latex polymer.

Latex Polymer

The latex polymer for use in the receptor layer is a dispersion in which water-insoluble hydrophobic polymers are dispersed as fine particles in a water-soluble dispersion medium. The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. The dispersed particles preferably have a mean average particle size (diameter) of about 1 to 50,000 nm, more preferably about 5 to 1,000 nm.

The glass transition temperature (Tg) of the latex polymer that can be used in the present invention is preferably −30° C. to 100° C., more preferably 0° C. to 80° C., further preferably 10° C. to 70° C., and further more preferably 15° C. to 60° C.

The glass transition temperature (Tg) is calculated according to the following equation:

$$1/Tg=\Sigma(Xi/Tgi)$$

wherein, assuming that the polymer is a copolymer composed of n monomers from i=1 to i=n, Xi is a weight fraction of the i-th monomer (ΣXi=1) and Tgi is a glass transition temperature (absolute temperature scale) of a homopolymer formed from the i-th monomer. The symbol Σ means the sum of i=1 to i=n. The value of the glass transition temperature of a homopolymer formed from each monomer (Tgi) can be adopted from J. Brandrup and E. H. Immergut, "Polymer Handbook, 3rd. Edition", Wiley-Interscience (1989).

In a preferable embodiment of the present invention, latex polymers such as acrylic-series polymers, polyesters, rubbers (e.g., SBR resins), polyurethanes, polyvinyl chlorides, such as vinyl chloride/vinyl acetate copolymer, vinyl chloride/acrylate copolymer, and vinyl chloride/methacrylate copolymer; polyvinyl acetates, such as ethylene/vinyl acetate copolymer; and polyolefins, are preferably used. These latex polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number-average molecular weight.

The latex polymer is preferably exemplified by any one of latex polyesters; vinyl chloride latex copolymers such as vinyl chloride/acrylic compound latex copolymer, vinyl chloride/vinyl acetate latex copolymer, and vinyl chloride/vinyl acetate/acrylic compound latex copolymer, or arbitrary combinations thereof. Especially preferred are any one of vinyl chloride/acrylic compound latex copolymer, vinyl chloride/vinyl acetate latex copolymer, and vinyl chloride/vinyl acetate/acrylic compound latex copolymer, or arbitrary combinations thereof.

Examples of the polyvinyl chloride copolymer include those described above. Among these, VINYBLAN 240, VINYBLAN 270, VINYBLAN 276, VINYBLAN 277, VINYBLAN 375, VINYBLAN 380, VINYBLAN 386, VINYBLAN 410, VINYBLAN 430, VINYBLAN 432, VINYBLAN 550, VINYBLAN 601, VINYBLAN 602, VINYBLAN 609, VINYBLAN 619, VINYBLAN 680, VINYBLAN 680S, VINYBLAN 681N, VINYBLAN 683, VINYBLAN 685R, VINYBLAN 690, VINYBLAN 860, VINYBLAN 863, VINYBLAN 865, VINYBLAN 867, VINYBLAN 900, VINYBLAN 938 and VINYBLAN 950 (trade names, manufactured by Nissin Chemical Industry Co., Ltd.); and SE1320, S-830 (trade names, manufactured by Sumica Chemtex) are preferable.

The polyester latex is preferably exemplified by VIRONAL MD1200, VIRONAL MD1220, VIRONAL MD1245, VIRONAL MD1250, VIRONAL MD1500, VIRONAL MD1930, and VIRONAL MD1985 (trade names, manufactured by Toyobo Co., Ltd.).

A preferable addition amount of the latex polymer is in the range of from 50% by mass to 98% by mass, more preferably from 70% by mass to 95% by mass, in terms of solid content of the latex polymer in the receptor layer.

Water-Soluble Polymer

In the heat-sensitive transfer image-receiving sheet of the present invention, it is one of preferred embodiment that the receptor layer contains a water-soluble polymer.

Herein, the "water-soluble polymer" means a polymer which dissolves, in 100 g of water at 20° C., in an amount of preferably 0.05 g or more, more preferably 0.1 g or more, further preferably 0.5 g or more, and particularly preferably 1 g or more. As the water-soluble polymers, natural polymers, semi-synthetic polymers and synthetic polymers are preferably used.

The natural polymers and the semi-synthetic polymers will be explained in detail.

Specific examples include the following polymers: plant type polysaccharides, such as κ-carrageenans, ι-carrageenans, λ-carrageenans, and pectins; microbial type polysaccharides, such as xanthan gums and dextrins; animal type natural polymers, such as gelatins and caseins; and cellulose-based polymers, such as carboxymethylcelluloses, hydroxyethylcelluloses, and hydroxypropylcelluloses.

Of the natural polymers and the semi-synthetic polymers that can be used in the present invention, gelatin is preferred.

Gelatin having a molecular mass of from 10,000 to 1,000,000 may be preferably used in the present invention. Gelatin that can be used in the present invention may contain an anion, such as $Cl^-$ and $SO_4^{2-}$, or alternatively a cation, such as $Fe^{2+}$, $Ca^{2+}$, $Mg^{2+}$, $Sn^{2+}$, and $Zn^{2+}$. Gelatin is preferably added as an aqueous solution.

Of the water-soluble polymers that can be used in the heat-sensitive transfer image-receiving sheet of the present invention, examples of the synthetic polymers include polyvinyl pyrrolidone, polyvinyl pyrrolidone copolymers, polyvinyl alcohol, polyethylene glycol, polypropylene glycol, and water-soluble polyesters.

Among the synthetic polymers that can be used in the present invention, polyvinyl alcohols are preferable.

As the polyvinyl alcohol, there can be used various kinds of polyvinyl alcohols such as complete saponification products thereof, partial saponification products thereof, and modified polyvinyl alcohols. With respect to these polyvinyl alcohols, those described in Koichi Nagano, et al., "Poval", Kobunshi Kankokai, Inc. are useful.

The viscosity of polyvinyl alcohol can be adjusted or stabilized by adding a trace amount of a solvent or an inorganic salt to an aqueous solution of polyvinyl alcohol, and use may be made of compounds described in the aforementioned reference "Poval", Koichi Nagano et al., published by Kobunshi Kankokai, pp. 144-154. For example, a coated-surface quality can be improved by an addition of boric acid, and the addition of boric acid is preferable. The amount of boric acid to be added is preferably 0.01 to 40 mass %, with respect to polyvinyl alcohol.

Specific examples of the polyvinyl alcohols include completely saponificated polyvinyl alcohol such as PVA-105, PVA-110, PVA-117 and PVA-117H (trade names, manufactured by KURARAY CO., LTD.); partially saponificated polyvinyl alcohol such as PVA-203, PVA-205, PVA-210 and PVA-220 (trade names, manufactured by KURARAY CO., LTD.); and modified polyvinyl alcohols such as C-118, HL-12E, KL-118 and MP-203 (trade names, manufactured by KURARAY CO., LTD.).

The heat-sensitive transfer image-receiving sheet of the present invention may contain any ultraviolet absorbents. As the ultraviolet absorbents, use can be made of conventionally known inorganic or organic ultraviolet absorbents. As the organic ultraviolet absorbents, use can be made of non-reactive ultraviolet absorbing agents such as salicylate-series, benzophenone-series, benzotriazole-series, triazine-series, substituted acrylonitrile-series, and hindered amine-series ultraviolet absorbents; and copolymers or graft polymers of thermoplastic resins (e.g., acrylic resins) obtained by introducing an addition-polymerizable double bond (e.g., a vinyl group, an acryroyl group, a methacryroyl group), or an alcoholic hydroxyl group, an amino group, a carboxyl group, an epoxy group, or an isocyanate group, to the non-reactive ultraviolet absorbents, subsequently copolymerizing or grafting. In addition, disclosed is a method of obtaining ultraviolet-shielding resins by the steps of dissolving ultraviolet absorbing agents in a monomer or oligomer of the resin, and then polymerizing the monomer or oligomer (JP-A-2006-21333). In this case, the ultraviolet absorbents may be non-reactive.

Of these ultraviolet absorbing agents, preferred are benzophenone-series, benzotriazole-series, and triazine-series ultraviolet absorbing agents. It is preferred that these ultraviolet absorbents are used in combination so as to cover an effective ultraviolet absorption wavelength region according to characteristic properties of the dye that is used for image formation. Besides, in the case of non-reactive ultraviolet absorbents, it is preferred to use a mixture of two or more kinds of ultraviolet absorbents each having a different structure from each other so as to prevent the ultraviolet absorbents from precipitation.

Examples of commercially available ultraviolet absorbing agents include TINUVIN-P (trade name, manufactured by Ciba-Geigy), JF-77 (trade name, manufactured by JOHOKU CHEMICAL CO., LTD.), SEESORB 701 (trade name, manufactured by SHIRAISHI CALCIUM KAISHA, LTD.), SUMISORB 200 (trade name, manufactured by Sumitomo Chemical Co., Ltd.), VIOSORB 520 (trade name, manufactured by KYODO CHEMICAL CO., LTD.), and ADKSTAB LA-32 (trade name, manufactured by ADEKA).

To the heat-sensitive transfer image-receiving sheet of the present invention, a release agent may be added to secure a releasing property between a heat-sensitive transfer sheet and the heat-sensitive transfer image-receiving sheet at the time of image printing.

As the release agent, there can be used, for example, solid waxes such as polyethylene wax, paraffin wax, fatty acid ester wax, and amide wax; and silicone oil, phosphoric acid ester-based compounds, fluorine-based surfactants, silicone-based surfactants, and other release agents known in this technical field. Of these release agents, preferred are fatty acid ester wax, fluorine-based surfactants, and silicone-based compounds such as silicone-based surfactants, silicone oil and/or hardened products thereof.

Further in the heat-sensitive transfer image-receiving sheet of the present invention, a surfactant may be contained in any of such layers as described above. Of these layers, it is preferable to contain the surfactant in the receptor layer and the inter layer.

An addition amount of the surfactant is preferably from 0.01% by mass to 5% by mass, more preferably from 0.01% by mass to 1% by mass, and especially preferably from 0.02% by mass to 0.2% by mass, based on the total solid content.

With respect to the surfactant, various kinds of surfactants such as anionic, nonionic and cationic surfactants are known. As the surfactant that can be used in the present invention, any known surfactants may be used. For example, it is possible to use surfactants as reviewed in "Kinosei kaimenkasseizai (Functional Surfactants)", editorial supervision of Mitsuo Tsunoda, edition on August in 2000, Chapter 6. Of these surfactants, fluorine-containing anionic surfactants are preferred.

To the heat-sensitive transfer image-receiving sheet of the present invention, a matting agent may be added in order to prevent blocking, or to give a release property or a sliding property. The matting agent may be added on the same side as a coating side of the receptor layer, or on the side opposite to the coating side of the receptor layer, or on both sides thereof.

In the heat-sensitive transfer image-receiving sheet of the present invention, examples of the matting agent generally include fine particles of water-insoluble organic compounds and fine particles of water-insoluble inorganic compounds. In the present invention, organic compound-containing fine particles are used from the viewpoints of dispersion properties. In so far as an organic compound is incorporated in the particles, there may be organic compound particles consisting of the organic compound alone, or alternatively organic/inorganic composite particles containing not only the organic compound but also an inorganic compound. As the matting agent, there can be used organic matting agents described in, for example, U.S. Pat. No. 1,939,213, No. 2,701,245, No. 2,322,037, No. 3,262,782, No. 3,539,344, and No. 3,767,448.

To the heat-sensitive transfer image-receiving sheet of the present invention, antiseptics may be added. The antiseptics that may be used in the image-receiving sheet of the invention are not particularly limited. For example, use can be made of materials described in *Bofubokabi* (*Preservation and Anti-fungi*) *HAND BOOK*, Gihodo shuppan (1986), *Bokin Bokabi no Kagaku* (*Chemistry of Anti-bacteria and Anti-fungi*) authored by Hiroshi Horiguchi, Sankyo Shuppan (1986), *Bokin Bokabizai Jiten* (*Encyclopedia of Antibacterial and Antifungal Agent*) edited by The Society for Antibacterial and Antifungal Agent, Japan (1986). Examples thereof include imidazole derivatives, sodium dehydroacetate, 4-isothiazoline-3-on derivatives, benzoisothiazoline-3-on, benzotriazole derivatives, amidineguanidine derivatives, quaternary ammonium salts, pyrrolidine, quinoline, guanidine derivatives, diazine, triazole derivatives, oxazole, oxazine derivatives, and 2-mercaptopyridine-N-oxide or its salt. Of these antiseptics, 4-isothiazoline-3-on derivatives and benzoisothiazoline-3-on are preferred.

In the heat-sensitive transfer image-receiving sheet of the present invention, at least one receptor layer is preferably formed by application of an aqueous type coating liquid. In producing the image-receiving sheet provided with two or more receptor layers, it is preferable that all the receptor layers are formed by application of aqueous type coating liquids, and then they are dried. The "aqueous type" here means that 60% by mass or more of the solvent (dispersion medium) of the coating liquid is water. As a component other than water in the coating liquid, a water miscible organic solvent may be used, such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

The amount of the receptor layer to be applied is preferably 0.5 to 10 g/m$^2$ (solid basis, hereinafter, the amount to be applied in the present specification means a value on solid basis, unless otherwise specified). A film thickness of the receptor layer is preferably in the range of from 0.1 μm to 30 μm with respect to at least one layer. It is preferred that a thickness of at least one receptor layer on each of both sides of the support is in the range of from 0.1 μm to 30 μm. It is more preferred that a thickness of at least one receptor layer on each of both sides of the support is in the range of from 1 μm to 20 μm.

Heat Insulation Layer

The heat-sensitive transfer image-receiving sheet of the present invention preferably has a heat insulation layer between the support and the receptor layer. The image-receiving sheet of the second embodiment has a heat insulation layer containing at least one hollow polymer particles. This is also a preferable embodiment in the first embodiment. The heat insulation layer may be a single layer, or double or even more multi layers.

In the heat-sensitive transfer image-receiving sheet of the present invention, it is preferred that the heat insulation layer contains hollow polymer particles. Especially, it is essential in the second embodiment that the heat insulation layer contains hollow polymer particles.

The hollow polymer particles in the present invention are polymer particles having voids inside of the particles. The hollow polymer particles are preferably water dispersion. Examples of the hollow polymer particles include (1) non-foaming type hollow particles obtained in the following manner: dispersion medium such as water is contained inside of a capsule wall formed of a polystyrene, acryl resin, or styrene/acrylic resin, and, after a coating liquid is applied and dried, the water in the particles is vaporized out of the particles, with the result that the inside of each particle forms a hollow; (2) foaming type microballoons obtained in the following manner: a low-boiling point liquid, such as butane and pentane, is encapsulated in a resin constituted of any one of polyvinylidene chloride, polyacrylonitrile, polyacrylic acid, and polyacrylate, or their mixture or polymer, and after the resin coating material is applied, it is heated to expand the low-boiling point liquid inside of the particles, whereby the inside of each particle is made to be hollow; and (3) microballoons obtained by foaming the above (2) under heating in advance, to make hollow polymer particles.

Specific examples of the above (1) include Rohpake 1055, manufactured by Rohm and Haas Co.; Boncoat PP-1000, manufactured by Dainippon Ink and Chemicals, Incorporated; SX866(B), manufactured by JSR Corporation; and Nippol MH5055, manufactured by Nippon Zeon (all of these product names are trade names). Specific examples of the above (2) include F-30, and F-50, manufactured by Matsumoto Yushi-Seiyaku Co., Ltd. (all of these product names are trade names). Specific examples of the above (3) include F-30E, manufactured by Matsumoto Yushi-Seiyaku Co., Ltd, and Expancel 461DE, 551DE, and 551DE20, manufactured by Nippon Ferrite (all of these product names are trade names).

Of these, non-foaming hollow polymer particles of the foregoing (1) are preferred. If necessary, use can be made of a mixture of two or more kinds of polymer particles.

The average particle diameter (particle size) of the hollow polymer particles is preferably 0.1 to 5.0 μm, more preferably 0.2 to 3.0 μm, and particularly preferably 0.3 to 1.0 μm.

The hollow ratio (percentage of hollowness) of the hollow polymer particles is preferably in the range of from about 20% to about 70%, and particularly preferably from 20% to 50%.

In the present invention, the particle size of the hollow polymer particle is calculated after measurement of the circle-equivalent diameter of the periphery of particle under a transmission electron microscope. The average diameter is determined by measuring the circle-equivalent diameter of the periphery of at least 300 hollow polymer particles observed under the transmission electron microscope and obtaining the average thereof.

The hollow ratio of the hollow polymer particles is calculated by the ratio of the volume of voids to the volume of a particle.

The glass transition temperature (Tg) of the hollow polymer particles that can be used in the heat-sensitive transfer image-receiving sheet of the present invention is preferably 70 to 200° C., more preferably 90 to 180° C.

It is preferred that the heat insulation layer contains a water-soluble polymer as a binder in addition to hollow polymer particles. A preferable water-soluble polymer is exemplified by water-soluble polymers described in the section of Receptor layer. Among these water-soluble polymers, gelatin and a polyvinyl alcohol are more preferable. These resins may be used either singly or as a mixture thereof.

A thickness of the heat insulation layer containing the hollow polymer particles is preferably from 5 to 50 μm, more preferably from 5 to 40 μm.

Interlayer

An interlayer may be formed between the receptor layer and the support. A function of the interlayer is exemplified by white background adjustment, antistatic, imparting of adhesion and imparting of smoothness (leveling). The function of the interlayer is not limited to these and a previously known interlayer may be provided. Disposal of the interlayer is essential in the second embodiment, and preferable in the first embodiment.

The interlayer preferably contains a water-soluble polymer or latex polymer excluding gelatin.

As the support that is used for the heat-sensitive transfer image-receiving sheet of the present invention, there may be used previously known supports with a preferable example being a water-proof support. The usage of the water-proof support enables to prevent the support from absorbing moisture thereto, so that a change in properties of the receptor layer with the lapse of time can be prevented. As the water-proof support, there may be, for example, a coat paper, a laminate paper and a synthetic paper with a preferable example being a laminate paper.

Method of Producing Heat-Sensitive Transfer Image-Receiving Sheet

These heat-sensitive transfer image-receiving sheets are produced by the steps of preparing coating liquids, applying the coating liquids to the support and drying them. In the present invention, at least one receptor layer is coated. The image-receiving sheets in which the number of constituent layers of either or both of their individual receptor layer and heat-insulation layer is two or more are also preferred embodiments of the present invention. In the present invention, at least the heat-insulation layer and a constituent layer adjacent thereto on the receptor layer side are preferably formed by simultaneous multilayer coating. The constituent layer on the receptor layer side may be either a receptor layer or an inter layer having another function.

Each of steps in the production process is described below in detail.

Preparation of Coating Liquids

For preparing coating liquids finally having liquid properties responsive to desired quality by measuring and mixing ingredients, known methods and apparatus can be utilized. Examples of a measurement method usable herein include a method of measuring weight and a method of measuring volume. Examples of an agitator usable for mixing include a propeller stirrer and a jet agitator.

On the occasion of adding gelatin, it is also possible to adopt a method in which gelatin powder is dispersed and impregnated in room-temperature water, the resulting swollen gelatin is made to dissolve with the rise of temperature, and then added to the coating liquids.

In order to measure physical properties of the coating liquid, there can be used various measuring apparatuses such as a viscometer, a surface tension measuring instrument, a hydrometer and a pH meter. A method of measuring viscosity of the coating liquid is classified into two methods: a method of measuring a resistance force that is imposed on a rotor in a liquid, and a method of measuring a pressure loss at the time when a liquid is passed through an orifice or a capillary. The former measuring apparatus is a rotary viscometer that is represented by a B-type viscometer. The latter is a capillary viscometer that is represented by Ostwald's viscometer. In the present invention, the former apparatus, namely, the rotary viscometer is used. The measurement was conducted at 40° C.

Coating

Coating of each layer can be preferably performed using a method chosen appropriately from the methods allowing simultaneous multilayer coating among known methods including roll coating, bar coating, gravure coating, gravure reverse coating, die coating, slide coating and curtain coating methods. Of these known methods, the curtain coating and slide coating methods are methods in which the thickness of coating film is determined by the flow rate of liquid dispensed by a pump or the like, and allow simultaneous multilayer coating.

It is known that in the case of producing an image-receiving sheet composed of plural layers having different functions from each other (for example, an air cell layer, a heat insulation layer, an inter layer and a receptor layer) on a support, it may be produced by applying each layer successively one by one, or by overlapping the layers each already coated on a support or substrate, as shown in, for example, JP-A-2004-106283, JP-A-2004-181888 and JP-A-2004-345267. It has been known in photographic industries, on the other hand, that productivity can be greatly improved, for example, by providing plural layers through simultaneous multi-layer coating. For example, there are known methods such as the so-called slide coating (slide coating method) and curtain coating (curtain coating method) as described in, for example, U.S. Pat. Nos. 2,761,791, 2,681,234, 3,508,947, 4,457,256 and 3,993,019; JP-A-63-54975, JP-A-61-278848, JP-A-55-86557, JP-A-52-31727, JP-A-55-142565, JP-A-50-43140, JP-A-63-80872, JP-A-54-54020, JP-A-5-104061, JP-A-5-127305, and JP-B-49-7050 ("JP-B" means examined Japanese patent publication); and Edgar B. Gutoff, et al., "Coating and Drying Defects: Troubleshooting Operating Problems", John Wiley & Sons Company, 1995, pp. 101-103. According to these coating methods, two or more kinds of coating liquids are fed simultaneously into a coater and formed into two or more different layers. These methods can be preferably applied to the present invention because they can deliver coating uniform in thickness and allow simultaneous multilayer coating.

As an example of apparatus for the slide coating method, there is a multilayer slide bead coater proposed by Russell et al. in U.S. Pat. No. 2,761,791. Examples of the shape of the coater are also described in Stephen F. Kistler & Petert M. Schweizer, "Liquid Film Coating", Chapman & Hall (1997).

The slide bead coater is mainly composed of a coating head and a backup roller which supports a support continuously moving as it is winding about the backup roll. In the inside of a coating head-forming block are provided liquid pools which diffusively flow their individual coating liquids dispensed from liquid feed lines to the width direction of the support, and narrow slits connected with these liquid pools are formed in an open state so as to reach a slide surface. This slide surface is formed on the top side of the coating head, and inclined downward the backup roller side.

The coating liquids fed into their respective liquid pools are pressed out of their individual slits onto the slide surface, successively superposed upon one another as they are running down on the slide surface, thereby forming a multilayer coating, and reach to the tip of the lower end of the slide surface, on the whole, without mixing much with one another. The coating liquids arriving at the tip form their beads in the gap between the tip and the surface of the support moving continuously as it is winding about the backup roll, and applied to the support via these coating liquid beads. For the purpose of stabilizing the beads, the pressure imposed on the lower part is reduced. Therefore, a decompression chamber is formed at the lower place of the backup roller. This decompression chamber forms a negative pressure on the lower side of the beads, and the negative pressure functions so as to not only stabilize the beads but also allow easy running-down of excess coating liquids, which remain without applied to web, into the decompression chamber.

The curtain coating is a method of coating a freely falling liquid film on a support continuously running underneath the liquid film at a constant speed. This method has some coating systems including an extrusion system and a slide system. In the slide coater, a multilayer liquid film formed on a slide surface falls freely from the slide end. Therefore, the shape of the terminal of the slide surface is devised so as to smoothly form the falling liquid film.

In the simultaneous multilayer coating, it is required that the viscosity and surface tension of a coating liquid to form each layer be adjusted so that formation of homogeneous coating film and satisfactory coating properties are achieved. The viscosity of each coating liquid can be easily adjusted by using known thickeners or viscosity-depressants. And the surface tension of each coating liquid can be adjusted by addition of various surfactants.

In the present invention, the viscosity of the receptor layer can be adjusted by a solid content and/or using a thickener. The viscosity of each receptor layer at 40° C. is preferably in the range of from 3 mPa·s to 300 mPa·s, more preferably from 3 mPa·s to 100 mPa·s, and most preferably from 3 mPa·s to 30 mPa·s.

In feeding into a coating section each coating liquid prepared so as to have appropriate values of physical properties including concentration, viscosity, surface tension and pH, it is required that the coating liquid is continuously fed as foams and extraneous materials are eliminated.

Although various methods allow continuous feeding of each coating liquid at a constant flow rate, it is preferable to use a metering pump in terms of accuracy and reliability. Examples of the metering pump include a plunger pump and a diaphragm type pump. In the diaphragm type pump, a plunger and a liquid to be fed are placed in isolation by means of two diaphragms, and the motion of the plunger is transmitted by way of a driving oil and pure water between the two diaphragms to the liquid to be fed. Fluctuation in the flow rate of a liquid-feeding pump are linked with fluctuation in the coating film thickness, so sufficient accuracy is required for the flow rate.

When it is required to reduce influences of pulsation of a pump, an auxiliary device for absorbing pulsation is used.

Some systems for the auxiliary device are known, and one example thereof is a pulsation-absorbing device of pipeline type (JP-A-1-255793).

For elimination of extraneous materials, it is preferable to filter coating liquids. Various materials can be used as filtering media, and one example thereof is a cartridge filter. Prior to being used, filtering media preferably undergo treatment for prevention of mixing of air held in pores of the filtering media into coating liquids in the form of air bubbles. To such preventive treatment, several known methods are applicable. As an example thereof, mention may be made of pretreatment with a liquid containing a surfactant (U.S. Pat. No. 5,096,602).

Similarly to extraneous materials, air bubbles also become a cause of defects in coated surface conditions. Therefore, it is preferable that air bubbles mixed into coating liquids and foams floating on the solution surface are eliminated by defoaming and antifoaming treatment. As techniques for such treatment, there are separation of air bubbles from solutions and dissolution of air bubbles into solutions. Examples of a known technique for the separation include reduced-pressure defoaming, ultrasonic defoaming and centrifugal defoaming. And an example of a known technique for dissolution into solutions is ultrasonic pipeline defoaming.

In the case of using additives which degrade stability with lapse of time of a coating liquid to which they are added, it is known to adopt a system that the additives are added right before the coating liquid is fed into a coating section, during the liquid-feeding process, for the purpose of reducing a time lapsed from the addition to the coating. This system can be utilized in the present invention too. Examples of a mixer usable therein include a static mixer and a dynamic mixer.

With respective to a receptor layer coating liquid that is used in the present invention, a solid contend is preferably in the range of from 5% by mass to 50% by mass, and a coated amount of the coating liquid is preferably in the range of from 3 ml/m$^2$ to 300 ml/m$^2$, based on the receptor layer coating liquid coated per one coating operation.

Drying

After coating, a coated product having a coating film formed on a support is dried in a drying zone, made to pass through a humidity conditioning zone, and then wound into a roll. In the present invention, it is preferable that a multilayer coating film on a support is solidified immediately after the formation thereof. When the coating film is exposed to a strong drying wind while it is still in an insufficiently-solidified state, wave motion is caused and unevenness shows up. In addition, when an organic solvent is contained in the outermost layer of the coating film, the wind causes nonuniform evaporation of the organic solvent on the slide surface and immediately after coating to result in occurrence of unevenness. From this point of view, it is advantageous to adopt aqueous coating liquids.

In another case where a binder capable of gelling at low temperatures, such as gelatin, is contained in coating liquids, it is preferable that the coating film is subjected to cooling solidification through quick decrease in temperature immediately after multiple layers are formed on a support (set process), and then drying is performed under raised temperatures. By doing so, more uniform and more homogenous coating film can be formed.

The term "set process" as used herein means a gelling promotion process in which the viscosity of a coating film composition is increased by decreasing the temperature, e.g., through exposure of the coating film to a cold wind; as a result, inter-layer mobility and intra-layer mobility of ingredients are declined.

In the present invention, a temperature condition of the set process in which the cold wind is used is preferably less than 25° C. in dry-bulb temperature, more preferably 15° C. or less in dry-bulb temperature. The coating film is preferably exposed to the cold wind within 5 seconds directly after coating. A period of time when the coating film is exposed to the cold wind depends on a coating transport speed, but preferably not less than 3 seconds, more preferably from 3 seconds to 120 seconds, and furthermore preferably from 15 seconds to 100 seconds. At this step, it is preferred that the drying temperature is kept at a uniform temperature in the range of the above-described temperature.

Further, after 5 seconds but within 60 seconds immediately after coating, the coating film is preferably kept, at a uniform temperature in the range of less than 80° C. in dry-bulb temperature, for a period of time of preferably not less than 3 seconds, more preferably ranging from 3 seconds to 120 seconds, and furthermore preferably from 15 seconds to 100 seconds.

By controlling the set conditions as described above, effects of the invention can be effectively attained.

In the present invention, the viscosity of each receptor layer at 40° C. is preferably in the range of from 3 mPa·s to 300 mPa·s, more preferably from 3 mPa·s to 100 mPa·s, and most preferably from 3 mPa·s to 30 mPa·s, as described above. It is preferred that the receptor layer contains neither raw materials nor chemicals capable of enhancing a set property at the set process. Specifically, it is preferred to add none of various kinds of known gelling agents to a subbing layer-coating liquid. The gelling agents are exemplified by gelatin, pectin, agar, carrageenan, and Jerangam.

Since latex is a main constituent of coating liquids in the present invention, the coating film causes uneven shrinkage when they are quickly dried, and thereby cracks tend to develop in the dried coating film. Therefore, slow drying is preferred in the present invention. In order to satisfy such a requirement, it is required that the drying temperature and the volume and dew point of drying wind be adjusted appropriately and drying be performed while controlling the drying speed.

Typical drying devices include an air-loop system and a helical system. The air-loop system is a system in which drying blasts are made to blow on a coated product supported by rollers, and wherein a duct may be mounted either longitudinally or transversely. Such a system has a high degree of freedom in setting of the volume of drying wind, because a drying function and a transporting function are basically separated therein. However, many rollers are used therein, so base-transporting failures, such as gathering, wrinkling and slipping, tend to occur. The helical system is a system in which a coated product is wound round a cylindrical duct in a helical fashion, and transported and dried as it is floated by drying wind (air floating). So no support by rollers is basically required (JP-B-43-20438). In the present invention, these drying devices can be preferably used.

The present invention enables to provide a heat-sensitive transfer image-receiving sheet that forms a high quality image on both sides thereof, and satisfies the requirements for photo books, and moreover that is suitable for production thereof, and to provide a method of producing the above-described heat-sensitive transfer image-receiving sheet. In addition, the present invention enables to provide heat-sensitive transfer image-receiving sheets wherein after formation of the receptor layers, even though these sheets are stored in the state such that both sides of the sheets are contacted with each other, both sides do not adhere to each other.

The present invention will be described in more detail based on the following examples, but the invention is not intended to be limited thereto. In the following examples, the terms "part(s)" and "%" are values by mass, unless otherwise specified.

EXAMPLES

Preparation of Heat-Sensitive Transfer Sheet

A polyester film 6.0 μm in thickness (trade name: Diafoil K200E-6F, manufactured by MITSUBISHI POLYESTER FILM CORPORATION), that was subjected to an adhesion-treatment on one surface of the film, was used as a support. The following back sidelayer-coating liquid was applied onto the support on the other surface that was not subjected to the adhesion-treatment, so that the coating amount based on the solid content after drying would be 1 g/m$^2$. After drying, the coated film was hardened by heat at 60° C.

A heat-sensitive transfer sheet was prepared by coating the following coating liquids on the easy adhesion layer coating side of the thus-prepared polyester film so that a yellow heat transfer layer, a magenta heat transfer layer, a cyan heat transfer layer, and a transfer protective layer laminate would be disposed sequentially in this order. The coating amount of each dye layer based on the solid content was 0.8 g/m$^2$.

The transfer protective layer laminate was prepared by the following procedure: (1) applying and drying of a releasing layer-coating liquid on a support, (2) applying and drying of a protective layer-coating liquid on the dried releasing layer, and (3) applying and drying of an adhesion layer-coating liquid on the dried protective layer.

| Back side layer-coating liquid | |
|---|---|
| Acrylic-series polyol resin (trade name: ACRYDIC A-801, manufactured by Dainippon Ink and Chemicals, Incorporated) | 18.0 mass parts |
| Zinc stearate (trade name: SZ-2000, manufactured by Sakai Chemical Industry Co., Ltd.) | 0.70 mass part |
| Phosphate (trade name: PLYSURF A217, manufactured by Dai-ichi Kogyo Seiyaku Co., Ltd.) | 1.82 mass parts |
| Isocyanate (50% solution) (trade name: BURNOCK D-800, manufactured by Dainippon Ink and Chemicals, Incorporated) | 5.6 mass parts |
| Methyl ethyl ketone/Toluene (1/1, at mass ratio) | 75 mass parts |

| Yellow dye layer-coating liquid | |
|---|---|
| Dye compound (Y-1) | 4.2 mass parts |
| Dye compound (Y-2) | 3.6 mass parts |
| Polyvinylacetal resin (trade name: ESLEC KS-1, manufactured by Sekisui Chemical Co., Ltd.) | 6.1 mass parts |
| Polyvinylbutyral resin (trade name: DENKA BUTYRAL #6000-C, manufactured by DENKI KAGAKU KOGYOU K. K.) | 2.1 mass parts |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/Toluene (2/1, at mass ratio) | 84 mass parts |

Y-1

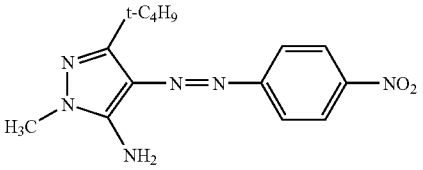

-continued

Y-2

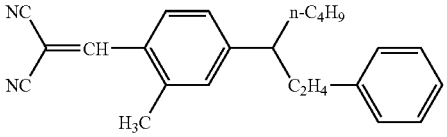

| Magenta dye layer-coating liquid | |
|---|---|
| Dye compound (M-1) | 1.8 mass parts |
| Dye compound (M-2) | 7.6 mass parts |
| Polyvinylacetal resin (trade name: ESLEC KS-1, manufactured by Sekisui Chemical Co., Ltd.) | 8.0 mass parts |
| Polyvinylbutyral resin (trade name: DENKA BUTYRAL #6000-C, manufactured by DENKI KAGAKU KOGYOU K. K.) | 0.2 mass part |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |
| Matting agent (trade name: Flo-thene UF, manufactured by Sumitomo Seika Chemicals Co., Ltd.) | 0.15 mass part |
| Methyl ethyl ketone/Toluene (2/1, at mass ratio) | 84 mass parts |

M-1

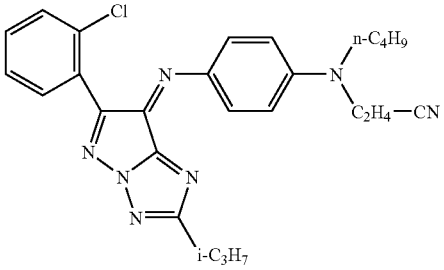

M-2

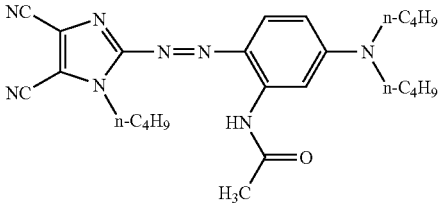

| Cyan dye layer-coating liquid | |
|---|---|
| Dye compound (C-1) | 2.4 mass parts |
| Dye compound (C-2) | 5.3 mass parts |
| Polyvinylacetal resin (trade name: ESLEC KS-1, manufactured by Sekisui Chemical Co., Ltd.) | 7.4 mass parts |
| Polyvinylbutyral resin (trade name: DENKA BUTYRAL #6000-C, manufactured by DENKI KAGAKU KOGYOU K. K.) | 0.8 mass part |
| Releasing agent (trade name: X-22-3000T, manufactured by Shin-Etsu Chemical Co., Ltd.) | 0.05 mass part |
| Releasing agent (trade name: TSF4701, manufactured by MOMENTIVE Performance Materials Japan LLC.) | 0.03 mass part |

-continued

| Cyan dye layer-coating liquid | |
|---|---|
| Matting agent (trade name: Flo-thene UF, manufactured by Sumitomo Seika Chemicals Co., Ltd.) | 0.15 mass part |
| Methyl ethyl ketone/Toluene (2/1, at mass ratio) | 84 mass parts |

C-1

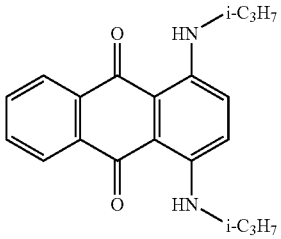

C-2

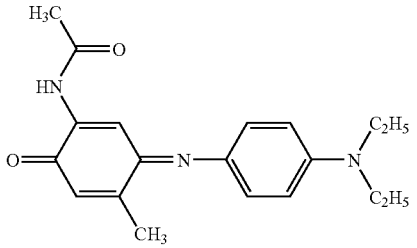

Transfer Protective Layer Laminate

On the same polyester film as used in the preparation of the dye layers as described above, coating liquids of a releasing layer, a protective layer and an adhesive layer each having the following composition were coated, to form a transfer protective layer laminate. Coating amounts of the releasing layer, the protective layer and the adhesive layer after drying were 0.2 g/m$^2$, 0.5 g/m$^2$ and 2.0 g/m$^2$, respectively.

| Releasing layer-coating liquid | |
|---|---|
| Modified cellulose resin (trade name: L-30, manufactured by DAICEL CHEMICAL INDUSTRIES, LTD.) | 7.5 mass parts |
| Methyl ethyl ketone | 92.5 mass parts |
| **Protective layer-coating liquid** | |
| Acrylic resin solution (Solid content: 40%) (trade name: UNO-1, manufactured by Gifu Ceramics Limited) | 85 mass parts |
| Methanol/Isopropanol (1/1, at mass ratio) | 15 mass parts |
| **Adhesive layer-coating liquid** | |
| Acrylic resin (trade name: DIANAL BR-77, manufactured by MITSUBISHI RAYON CO., LTD.) | 25 mass parts |
| The following ultraviolet absorbent UV-1 | 1 mass part |
| The following ultraviolet absorbent UV-2 | 2 mass parts |
| The following ultraviolet absorbent UV-3 | 1 mass part |
| The following ultraviolet absorbent UV-4 | 2 mass parts |
| PMMA fine particles (polymethyl methacrylate fine particles) | 0.4 mass part |
| Methyl ethyl ketone/Toluene (2/1, at mass ratio) | 70 mass parts |

-continued (UV-1)

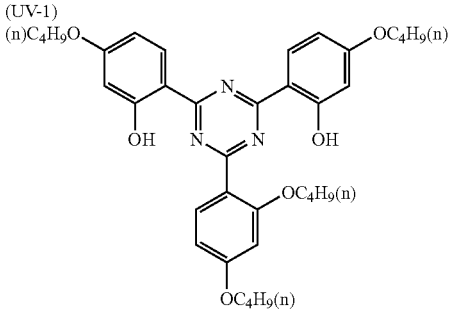

(UV-2)

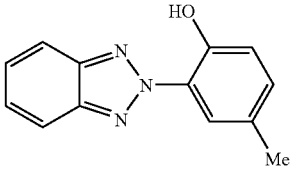

(UV-3)

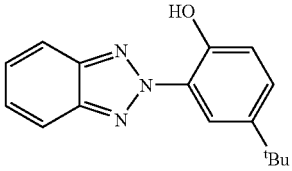

(UV-4)

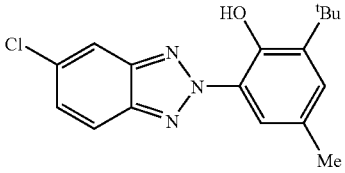

Example 1

Preparation of Heat-Sensitive Transfer Image-Receiving Sheet 101 of the Present Invention A synthetic paper (YUPO FPG200, thickness: 200 μm, trade name, a product of YUPO CORPORATION) was provided as a support, and on both sides of the support, a receptor layer-coating liquid 1 with the following composition was coated using a bar coater on each side. The coating liquid was coated so that the dried coating amount of each of the receptor layer became 5.6 g/m$^2$.

| Receptor layer-coating liquid 1 | |
|---|---|
| Vinyl chloride-series latex (trade name: Vinybran 900, Tg: 70° C., manufactured by Nisshin Chemicals Co., Ltd.) | 18.0 mass parts |
| Polyester-series latex (trade name: MD-1200, Tg: 67° C., manufactured by Toyobo Co., Ltd.) | 10.0 mass parts |
| Gelatin (10% solution) | 3.5 mass parts |
| Ester-series wax EW-1 presented below | 2.5 mass parts |
| Surfactant F-1 presented below | 0.1 mass part |

Preparation of Heat-Sensitive Transfer Image-Receiving Sheet 102 of the Present Invention Both sides of a paper support double-sides laminated with polyethylene were subjected to a corona discharge treatment, and then on both sides was disposed a gelatin subbing layer containing sodium dodecylbenzene sulfonate. Thereafter, on both sides were simultaneously multilayer coated a subbing layer, a heat insulation layer, and a receptor layer each having the following compositions in the form such that they were superposed in this order from the support in each side according to an exemplified method of FIG. 9 described in U.S. Pat. No. 2,761,791. The coating liquids were each coated so that a dried coating amounts of the subbing layer, the heat insulation layer, and the receptor layer became 5.6 g/m$^2$, 9.2 g/m$^2$, and 5.6 g/m$^2$, respectively. The following compositions indicate mass parts in terms of solid content.

| Receptor layer-coating liquid 1 | |
|---|---|
| Vinyl chloride-series latex (trade name: Vinybran 900, Tg: 70° C., manufactured by Nisshin Chemicals Co., Ltd.) | 18.0 mass parts |
| Polyester-series latex (trade name: MD-1200, Tg: 67° C., manufactured by Toyobo Co., Ltd.) | 10.0 mass parts |
| Gelatin (10% solution) | 3.5 mass parts |
| Ester-series wax EW-1 presented below | 2.5 mass parts |
| Surfactant F-1 presented below | 0.1 mass part |
| **Heat insulation layer-coating liquid 1** | |
| Hollow latex polymer (trade name: MH5055, manufactured by Nippon Zeon Co., Ltd.) | 60.0 mass parts |
| Gelatin (10% solution) | 20.0 mass parts |
| **Subbing layer-coating liquid 1** | |
| Polyvinyl alcohol (trade name: PovalPVA205, manufactured by KURARY CO., LTD.) | 15.0 mass parts |
| Styren-Butadiene rubber latex (trade name: SN-102, manufactured by NIPPON A&L INC.) | 55.0 mass parts |
| Surfactant F-1 presented below | 0.03 mass part |

(EW-1)

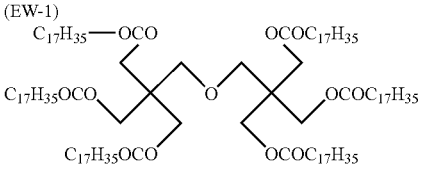

(F-1)

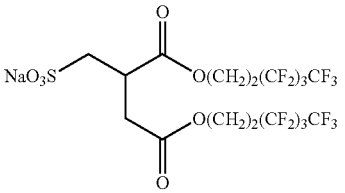

Preparation of Heat-Sensitive Transfer Image-Receiving Sheet 103 for Comparative Example A synthetic paper (YUPO FPG200, thickness: 200 μm, trade name, a product of YUPO CORPORATION) was provided as a support, and on both sides of the support, an interlayer-coating liquid and a receptor layer-coating liquid each having the following compositions were coated using a bar coater in each side according to the method described in JP-A-5-229265. The coating liquids were each coated in the proportion such that a dried coating amount of the interlayer and the receptor layer became 1.0 g/m$^2$ and 4.0 g/m$^2$, respectively, and then provisionally dried by a dryer. After that, the provisionally dried material was dried for 30 minutes at 100° C. in an oven to complete a receptor layer. Subsequently, both embossing and matting of the surface with a sand processing or a sand paper were performed to prepare a comparative heat-sensitive transfer image-receiving sheet.

| Composition of Interlayer-coating liquid | |
|---|---|
| Polyurethane resin Emulsion | 100 mass parts |
| Water | 30 mass parts |
| **Composition of Receptor layer-coating liquid** | |
| Vinyl chloride/vinyl acetate copolymer (trade name: #1000D, manufactured by DENKI KAGAKU KOGYOU K. K.) | 100 mass parts |
| Amino-modified silicone(Trade name: X-22-343, manufactured by Shin-Etsu Chemical Co., Ltd.) | 3 mass parts |
| Epoxy-modified silicone (Trade name: KF-343, manufactured by Shin-Etsu Chemical Co., Ltd.) | 3 mass parts |
| Methyl ethyl ketone/Toluene (1/1, at mass ratio) | 500 mass parts |

Image Formation

Using the above-described heat-sensitive transfer sheet and the above-described heat-sensitive transfer image-receiving sheet, 40 images of ordinary landscape were printed as described below by a thermal transfer type printer DBP-6000 manufactured by Nidec Copal Corporation. Namely, at first 10 copies were printed so that 2 images with a white edge (margin) were entered in the size of 8 inches×10 inches. After output, the heat-sensitive transfer image-receiving sheet was set reversely, and the remaining 20 images of ordinary landscape were printed so that 2 images with a white edge (margin) were entered in the size of 8 inches×10 inches. In each of the heat-sensitive transfer image-receiving sheets 101 and 102 of the invention, 10 copies of high quality double-side images were obtained.

Storage Stability of Image-Receiving Sheet

The heat-sensitive transfer image-receiving sheets 101 to 103 were preserved for 7 days under the environment of 50° C. and 85% RH so that they were superposed on their both sides. With respect to the heat-sensitive transfer sheet 103 for comparison, both sides thereof solidly adhered with each other so that it was difficult to separate from each other. In contrast, the heat-sensitive transfer image-receiving sheets 101 to 102 of the invention did not adhere. Consequently, there was no trouble in processing and usage after reservation.

Storage Stability of Output Image

The heat-sensitive transfer image-receiving sheets 101 to 103 were reserved for 3 days under the environment of 70° C. and 80% RH so that they were superposed on their both sides. With respect to the heat-sensitive transfer sheet 103 for comparison, images on both sides thereof were intermixed, so that the image quality was extremely deteriorated. In contrast, there was no intermixing of images on both sides of each of the heat-sensitive transfer image-receiving sheets 101 to 102 according to the invention. Consequently, there was no trouble in preservation with high image quality.

From the above-described results, it is understood that the heat-sensitive transfer image-receiving sheet of the present invention enables to provide high quality double side prints and the obtained prints excel in preservation properties after coating, so the effects of the present invention are remarkable.

Example 2

Preparation of Heat-Sensitive Transfer Image-Receiving Sheets 201 to 206

Heat-sensitive transfer image-receiving sheets 201 to 206 of the invention were prepared in the same manner as the heat-sensitive transfer image-receiving sheet 102 in Example 1, except that the dye receptive latex polymer, the coating liquid conditions, and the temperature and period of time after coating were changed as described in Table 1 set forth below.

Each heat-sensitive transfer image-receiving sheet was processed to form an image and evaluated in the same manner as in Example 1.

Image Formation

Using the heat-sensitive transfer sheet prepared in Example 1 and the above-described heat-sensitive transfer image-receiving sheets 201 to 206, 40 images of ordinary landscape were printed as described below by a thermal transfer type printer DBP-6000 manufactured by Nidec Copal Corporation. Namely, at first 10 copies were printed so that 2 images with a white edge (margin) were entered in the size of 8 inches×10 inches. After output, the heat-sensitive transfer image-receiving sheet was set reversely, and the remaining 20 images of ordinary landscape were printed images of ordinary landscape were printed so that 2 images with a white edge (margin) were entered in the size of 8 inches×10 inches. In each of the heat-sensitive transfer image-receiving sheets 201 to 206 of the invention, 10 copies of high quality double-side images were obtained.

Storage Stability of Image-Receiving Sheet

The heat-sensitive transfer image-receiving sheets 201 to 206 were preserved for 7 days under the environment of 50° C. and 85% RH so that they were superposed on their both sides. Each of the heat-sensitive transfer image-receiving sheets 201 to 206 of the invention did not adhere. Consequently, there was no problem in processing and usage after reservation.

Storage Stability of Output Image

The heat-sensitive transfer image-receiving sheets 201 to 206 were reserved for 3 days under the environment of 70° C. and 80% RH so that they were superposed on their both sides. There was no intermixing of images on both sides of each of the heat-sensitive transfer image-receiving sheets 201 to 206 according to the invention. Consequently, there was no trouble in preservation with high image quality.

From the above-described results, it is understood that the heat-sensitive transfer image-receiving sheet of the present invention enables to provide high quality double side prints and the obtained prints excel in preservation properties after coating, so the effects of the present invention are remarkable.

These results were also described together in Table 1 below.

Even though print images were allowed to closely contact with each other face to face during preservation, their image quality did not deteriorate in the heat-sensitive transfer image-receiving sheet of the invention. Such result was a significant effect beyond expectation. According to the present invention, both heat-sensitive transfer image-receiving sheets and methods of producing the same were also attained that did not cause any adhesion at both sides owing to reservation after coating.

Having described our invention as related to the present embodiments, it is our intention that the invention not be limited by any of the details of the description, unless otherwise specified, but rather be construed broadly within its spirit and scope as set out in the accompanying claims.

What we claim is:

1. A heat-sensitive transfer image-receiving sheet having a support and, on each of both sides of the support, at least one receptor layer containing at least one kind of latex polymer and gelatin, wherein the latex polymer in at least one of the receptor layers is one or at least two kinds of latex polymer selected from vinyl chloride/acrylic compound latex copolymer, vinyl chloride/vinyl acetate latex copolymer, and vinyl chloride/vinyl acetate/acrylic compound latex copolymer.

2. The heat-sensitive transfer image-receiving sheet according to claim 1, wherein a thickness of at least one of the receptor layers is in the range of from 0.1 μm to 30 μm.

3. The heat-sensitive transfer image-receiving sheet according to claim 1, wherein a coating liquid for the receptor layer to be applied per one coating operation has a solid content in the range of from 5% by mass to 50% by mass.

4. The heat-sensitive transfer image-receiving sheet according to claim 1, wherein a coating liquid for at least one of the receptor layers has a viscosity in the range of from 3 mPa·s to 300 mPa·s.

5. The heat-sensitive transfer image-receiving sheet according to claim 1, wherein a coating amount of a coating

TABLE 1

| | Image-receiving sheet No. | | | | | |
|---|---|---|---|---|---|---|
| | 201 | 202 | 203 | 204 | 205 | 206 |
| Remarks | This invention | This invention | This invention | This invention | This invention | This invention |
| Dye-receptive latex polymer | VINYBLAN 276 | VINYBLAN 690 | VINYBLAN 900 | VINYBLAN 276 | VINYBLAN 690 | VINYBLAN 900 |
| Solid content (%) | 5 | 25 | 50 | 4 | 0.5 | 55 |
| Viscosity (mPa · s) | 3 | 40 | 300 | 2 | 300 | 310 |
| Coating amount (ml/m$^2$) | 300 | 85 | 3 | 85 | 300 | 2 |
| Temperature (° C.) within a period of time of 5 seconds or less after coating | 0 | 10 | 24 | 10 | 10 | 25 |
| Time (sec.) when the applied temperature is kept at the above-described temperature | 3 | 20 | 100 | 20 | 2 | 20 |
| Temperature (° C.) with a lapse of time of more than 5 seconds after coating | 25 | 35 | 79 | 25 | 81 | 40 |
| Time (sec.) when the applied temperature is kept at the above-described temperature | 3 | 120 | 480 | 480 | 120 | 2 |
| Storage Stability of image-receiving sheet (adhesion at both sides) | No occurrence | No occurrence | No occurrence | Adhesion was slightly found, but no trouble in production. | No occurrence | Adhesion was slightly found, but no trouble in production. |
| Storage Stability of output image (Image deterioration owing to image transfer to the sheet at the opposite side) | No occurrence | No occurrence | No occurrence | Image deterioration was slightly found, but no problem in quality. | Image deterioration was slightly found, but no problem in quality. | No occurrence |

liquid for the receptor layer to be applied per one coating operation is in the range of from 3 ml/m$^2$ to 300 ml/m$^2$.

6. The heat-sensitive transfer image-receiving sheet according to claim 1, wherein the at least one receptor layer is coated on each of both sides of the support, and the at least one receptor layer is kept for 3 seconds or more at a constant dry-bulb temperature of less than 25° C. with a lapse of time that is within 5 seconds directly after coating.

7. The heat-sensitive transfer image-receiving sheet according to claim 1, wherein the at least one receptor is coated on each of both sides of the support, and the at least one receptor layer is kept for 3 seconds or more at a constant dry-bulb temperature of less than 80° C. with a lapse of time that is after 5 seconds but within 60 seconds directly after coating.

8. The heat-sensitive transfer image-receiving sheet according to claim 1, having on each of both sides of the support, at least one interlayer, at least one heat insulation layer containing at least one kind of hollow polymeric particles, and the at least one receptor layer in this order from the support.

9. The heat-sensitive transfer image-receiving sheet according to claim 8, wherein at least one of the receptor layers contains at least one kind of latex polymer.

10. The heat-sensitive transfer image-receiving sheet according to claim 8, wherein the interlayer is free of gelatin.

11. A method of producing a heat-sensitive transfer image-receiving sheet as claimed in claim 1, which method comprises forming the at least one receptor layer by applying a receptor-layer coating-liquid which has a solid content in the range of from 5% by mass to 50% by mass, per one coating operation.

12. The method of producing a heat-sensitive transfer image-receiving sheet according to claim 11, wherein a viscosity of the receptor layer-coating liquid is in the range of from 3 mPa·s to 300 mPa·s.

13. The method of producing a heat-sensitive transfer image-receiving sheet according to claim 11, wherein a coating amount of the receptor layer-coating liquid coated per one coating operation is in the range of from 3 ml/m$^2$ to 300 ml/m$^2$.

14. The method of producing a heat-sensitive transfer image-receiving sheet according to claim 11, wherein the at least one receptor layer is kept for 3 seconds or more at a constant dry-bulb temperature of less than 25° C. with a lapse of time that is within 5 seconds directly after coating.

15. The method of producing a heat-sensitive transfer image-receiving sheet according to claim 11, wherein the at least one receptor layer is kept for 3 seconds or more at a constant dry-bulb temperature of less than 80° C. with a lapse of time that is after 5 seconds but within 60 seconds directly after coating.

* * * * *